United States Patent [19]

Scheer

[11] Patent Number: 4,580,738

[45] Date of Patent: Apr. 8, 1986

[54] CONTROLLED TENSION UNWINDING SYSTEM

[75] Inventor: Georges N. Scheer, Roodt, Luxembourg

[73] Assignee: The Goodyear Tire & Rubber Company, Akron, Ohio

[21] Appl. No.: 558,097

[22] Filed: Dec. 5, 1983

[51] Int. Cl.[4] ..... B65H 20/02; B65H 23/06; B65H 59/06

[52] U.S. Cl. ..... 242/55.2; 242/75.43; 242/76; 242/156.1

[58] Field of Search ..... 242/55, 55.2, 76, 75.4, 242/156.1, 67.3 R, 75.43, 66, 75.2, 75.45, 187

[56] References Cited

U.S. PATENT DOCUMENTS

| | | | |
|---|---|---|---|
| 1,626,409 | 4/1927 | Gwinn | 242/75.4 |
| 2,957,639 | 10/1960 | Muller | 242/75.2 |
| 3,368,771 | 2/1968 | Schmidt | 242/75.2 |
| 3,811,634 | 5/1974 | Edwards | 242/55 |
| 3,918,661 | 11/1975 | Kishi et al. | 242/55.2 |
| 3,927,844 | 12/1975 | Bond et al. | 242/67.3 R X |
| 4,170,504 | 10/1979 | Riggs | 242/55 X |

*Primary Examiner*—Harvey C. Hornsby
*Assistant Examiner*—Scott J. Haugland
*Attorney, Agent, or Firm*—Frederick K. Lacher; T. P. Lewandowski

[57] ABSTRACT

A supply roll of thin liner material for carrying a strip of resilient plastic material is mounted for rotation with the axis of rotation in a horizontal position. An arm is mounted adjacent the supply roll for swinging movement toward and away from the axis of rotation of the roll. A peel-off roller is mounted on the distal end of the arm and is rotatable for rolling engagement with the supply roll. The liner material carrying the strip of resilient plastic material is directed around the peel-off roller and over an idler roller located at a position such that a force component acting on the arm resulting from the tension in the liner is in the direction of the supply roll for urging the peel-off roller against the supply roll. This provides a regular and minimal tension in the liner while the liner is pulled off the supply roll over the idler roller and to a driven liner take-up. The diameter of the peel-off roller is small as compared to the diameter of the supply roll causing the liner to undergo a sharp change in direction when leaving the supply roll which facilitates the peeling off of the liner. After passing around the idler roller the liner carrying the strip of resilient plastic material passes over a separating roller for separating the strip of resilient plastic material from the liner.

9 Claims, 2 Drawing Figures

CONTROLLED TENSION UNWINDING SYSTEM

Figure 1:
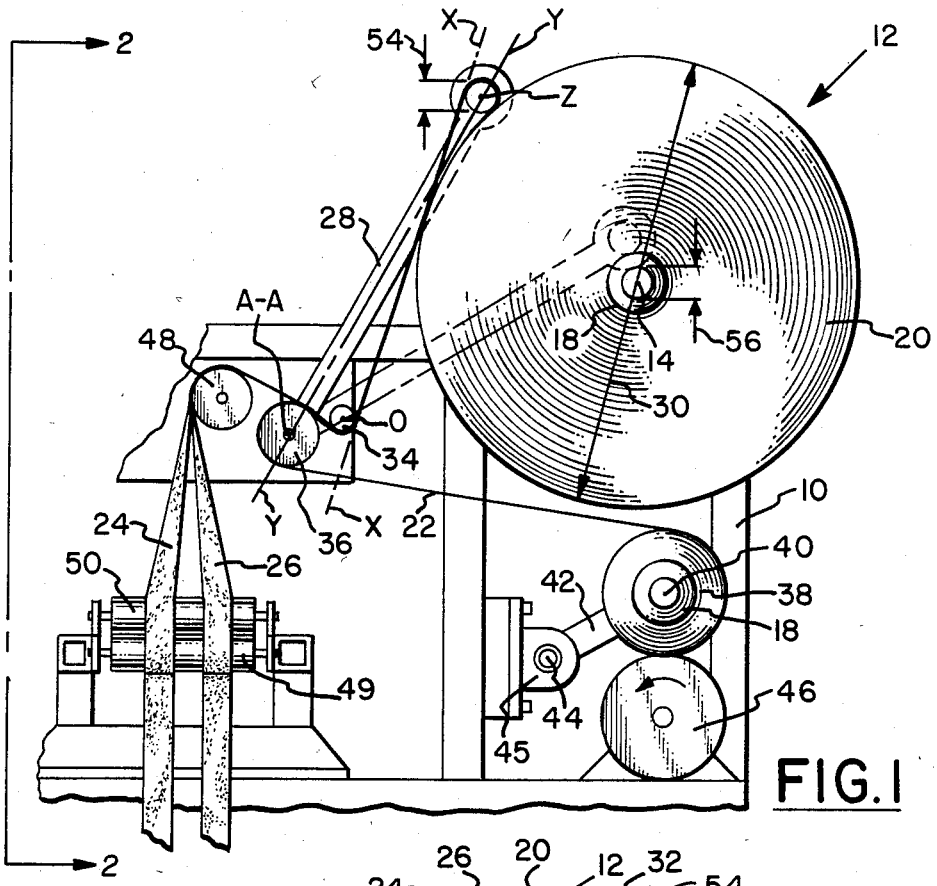

This invention relates generally to the supply of elongated bodies of resilient plastic material such as strips of unvulcanized rubber to apparatus for making tire components or directly to the tire building machine. The strips of unvulcanized rubber are generally tacky and must be carried on a liner of flexible sheet material which is wrapped on a spool. The strips are then pulled off the spool with the liner to a position where the strips are separated from the liner. In the past a friction brake has been mounted on the spool axle to restrain the rotation of the supply roll and provide the required tension in the liner as it is pulled off the supply roll. Difficulties have been had maintaining a substantially constant tension in the liner material as the diameter of the supply roll decreases during unwinding of the liner material. It has also been required that the liner material have a thickness sufficient to give the liner the necessary strength to overcome the resistance of the friction brake and this thickness has limited the length of the strips of unvulcanized rubber which can be carried on a supply roll of maximum diameter.

The present invention is directed to an unwinding system in which the friction brake on the spool axle is replaced by a peel-off roller engaging the surface of the supply roll and supported on an arm mounted for swinging movement toward and away from the supply roll. From the peel-off roller the liner is pulled over an idler roller which is positioned so that a force component acting on the arm and resulting from the tension in the liner is in the direction of the supply roll for urging the peel-off roller against the liner on the supply roll. The pressure on the supply roll provides the desired tension in the liner while at the same time it controls the rotation of the supply roll. This makes possible the use of a thin liner material and removal of the liner material and the strip of unvulcanized rubber from the supply roll without sticking of the strip to the opposite face of the liner. Furthermore, the tension in the liner is not changed significantly as the diameter of the supply roll is reduced.

In accordance with one aspect of this invention there is provided on unwinding system for unwinding a band of material from a supply roll comprising driving means for pulling the band off the supply roll, an arm mounted for swinging movement toward and away from the supply roll, a peel-off roller mounted for rotation on the arm and for rolling engagement with the supply roll as the band is pulled off the supply roll, and band guiding means for carrying the band from the peel-off roller to the driving means, the band guiding means being positioned so that a force component acting on the arm resulting from the tension in the band is in the direction of the supply roll for urging the peel-off roller against the wound band of material on the supply roll.

To the accomplishment of the foregoing and related ends, the invention, then, comprises the features hereinafter fully described and particularly pointed out in the claims the following description and the annexed drawings setting forth in detail a certain illustrative embodiment of the invention. This being indicative, however, of but one of the various ways in which the principles of the invention may be employed.

In the annexed drawings:

FIG. 1 is a fragmentary elevation of an unwinding system embodying the invention showing the arm and peel-off roller in full lines at a position for removing the band of liner material and the elongated body of resilient material from the supply roll in the substantially full condition. The position of the arm and peel-off roller with the supply roll in an almost empty condition is shown in dot-dash lines with the band of liner material being shown in chain dotted lines.

Figure 2:
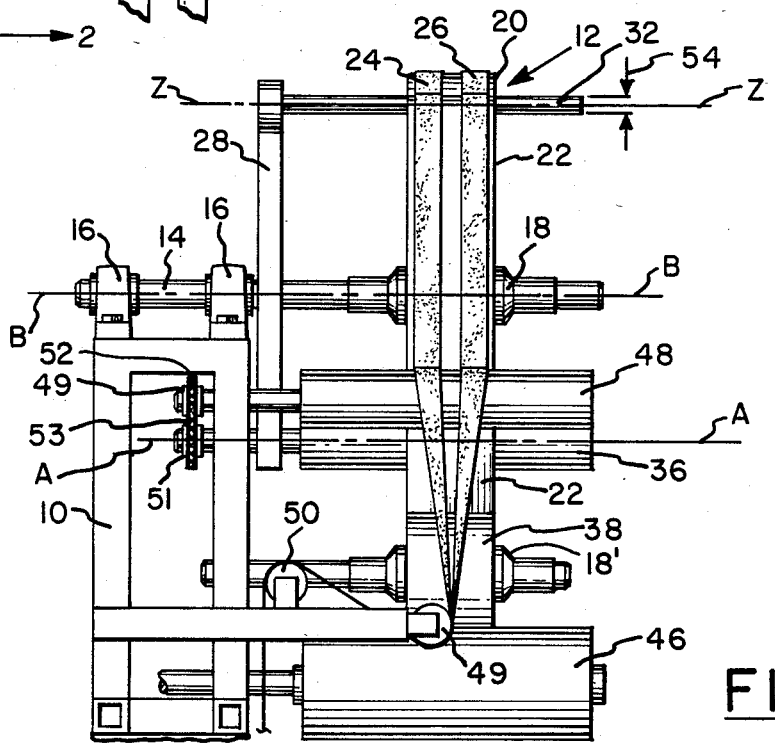

FIG. 2 is a sectional view taken along the line 2—2 of FIG. 1.

Referring to FIGS. 1 and 2, a portion of a frame 10 for supporting an unwinding system 12 is shown which may be mounted on the floor of a manufacturing plant. A supply roll shaft 14 is rotatably mounted on the frame 10 on pillow blocks 16 for receiving a spool 18 of a supply roll 20. A band of material such as liner 22 which carries at least one strip of resilient plastic material such as strips 24 and 26 of a unvulcanized rubber is wound on the spool 18. The strips 24 and 26 of tacky material are separated and carried by the liner 22 which may be of a thin plastic material.

An arm 28 is also rotatably mounted on the frame 10 for rotation about an axis A—A spaced from an axis B—B of the supply roll 20 a distance greater than one-half the maximum diameter 30 of the supply roll. A peel-off roller 32 is rotatably mounted on the distal end of the arm 28 at a position spaced from the pivotal axis A—A a distance at least equal to one-half the maximum diameter 30 of the supply roll 20. The peel-off roller 32 extends over the supply roll 20 and is mounted for swinging movement toward and away from the supply roll. A band guiding means includes an idler roller 34 mounted on the frame 10 with an axis O—O at a position spaced from axis A—A of arm 28. It also includes a separating roller 36 mounted on the frame 10 between the idler roller 34 and a driving means such as liner take-up 38 which includes a liner take-up shaft 40 for supporting the spool 18' on which the liner 22 is wrapped. The liner take-up shaft 40 may be mounted on an arm 42 rotatably mounted on a clevis pin 44 of a clevis 45 mounted on the frame 10. The liner take-up 38 on the shaft 40 is adjustably engageable with a drive roller 46 rotatable in the counterclockwise direction, as shown by the arrow in FIG. 1, to rotate the spool and wind up the liner 22. The drive roller 46 may be driven by an electric motor or other suitable power means at a predetermined speed controlled by speed controllers of a type well known to those skilled in the art. The separating roller 36 in this embodiment is rotated by the liner 22 and has an axis coincident with the axis A—A of the arm 28 and spaced from axis O—O of the idler roller 34.

A driven roller 48 may be mounted on the frame 10 for carrying the strips 24 and 26 to other rollers 49 and 50 which are positioned on the frame for carrying the strips to suitable conveyor and strip applying apparatus (not shown). The separating roller 36 has a sprocket 51 connected to a sprocket 52 for driven roller 48 by a chain 53 for driving the driven roller. The separating roller 36 and driven roller 48 have knurled surfaces and are of the same diameter. The sprocket 52 for driven roller 48 may have a slightly smaller diameter than the sprocket 51 of the separating roller 36 to take up any slack of the strips 24 and 26 as they are peeled off the liner 22.

Referring to FIG. 1, the supply roll 20 in the fully wrapped condition on the spool 18 is mounted for rotation on the supply roll shaft 14. The liner 22 is wrapped on the supply roll 20 with the strips 24 and 26 adhered to the radially inner surface of the liner by the tackiness of the unvulcanized rubber of which they are made. The liner 22 is pulled over the peel-off roller 32 with the strips 24 and 26 positioned radially outward of the supply roll and, as shown in FIG. 1, the liner and the strips are pulled under the idler roller 34 and over the separating roller 36 where the liner is separated from the strips and pulled around the liner take-up 38. The strips 24 and 26 are pulled around the driven roller 48 at a speed slightly greater than the speed of the separating roller 36 and then pass over the rollers 49 and 50.

The peel-off roller 32 has a small diameter 54 as compared to the diameter of the supply roll 20 causing the liner 22 and strips 24 and 26 to undergo a sharp change in direction when leaving the supply roll. It has been found that this is important for providing the peeling of the liner 22 and strips 24 and 26 from the supply roll 20. Preferably the diameter 54 of the peel-off roller 32 is no greater than one-third the smallest diameter 56 of the supply roll 20 as shown in dotted lines in FIG. 1.

Also as shown in FIG. 1, the idler roller 34 is positioned so that a force component acting on the arm 28 resulting from the tension in the liner 22 is in the direction of the supply roll 20 for urging the peel-off roller 32 toward the shaft 14 and against the liner on the supply roll. In this embodiment, a plane X—X is tangential to a surface of the peel-off roller 32 radially outermost from the supply roll 20 and a surface of said idler roller 34 in contact with the liner 22. A plane Y—Y contains the pivotal axis A—A of the arm 28 and axis Z—Z of the peel-off roller 32. The idler roller 34 is located at a position so that in the operating range 58 of the system 12 the plane X—X intersects the plane Y—Y at a position between the pivotal axis A—A of the arm 28 and the pivotal axis Z—Z of the peel-off roller as shown in FIG. 1. With this construction the peel-off roller 32 is in contact with the outside of the supply roll 20 and the liner 22 and strips 24 and 26 on the supply roll are advanced the same distance as the portions of the liner and strips which are pulled off the roll. Accordingly no slack or tension will appear in the strips 24 and 26.

Because the arm 28 supporting the peel-off roller 32 is positioned to move toward the supply roll shaft 14 as the liner 22 and strips 24 and 26 are peeled off the supply roll 20, the rotation of the supply roll is controlled without the necessity of a friction brake. As shown in FIG. 1, the liner 22 extending from the peel-off roller 32 to the idler roller 34 may be in sliding engagement with the liner on the supply roll 20; however, this is not essential for the operation of the unwinding system.

Although the system will operate with the peel-off roller 32 having a smooth surface, it has been found that by providing a knurled surface the ability of the roller to grip and pull the liner 22 and strips 24 and 26 off the supply roll 20 is enhanced. The separating roller 36 and driven roller 48 further control the movement of the strips 24 and 26 after leaving the idler roller 34.

While a certain representative embodiment and details have been shown for the purpose of illustrating the invention, it will be apparent to those skilled in this art that various changes and modifications may be made therein without departing from the spirit or scope of the invention.

What is claimed is:

1. An unwinding system for unwinding a band of material from a supply roll and restraining the rotation of said supply roll comprising driving means for pulling said band off said supply roll, an arm mounted about a pivotal axis spaced from said supply roll for swinging movement toward and away from said supply roll, said pivotal axis of said arm being spaced from said supply roll a distance greater than one-half the maximum diameter of said supply roll, a peel-off roller mounted for rotation about a pivotal axis on said arm and for rolling pressure engagement with said supply roll as said band is pulled off said supply roll, and band guiding means for carrying said band from said peel-off roller to said driving means, said band guiding means including an idler roller positioned on the same side of said peel-off roller as said pivotal axis of said arm and on the same side of said pivotal axis as said supply roll, said idler roller being located at a position so that in the operating range of said system the plane tangential to a surface of said peel-off roller radially outermost from said supply roll and a surface in contact with said band of said idler roller intersects the plane containing said pivotal axis of said arm and said pivotal axis of said of said peel-off roller at a position between said pivotal axis of said arm and said pivotal axis of said peel-off roller so that the force from said driving means pulls said arm toward said supply roll for urging said peel-off roller against the wound band of material on said supply roll and the pressure on said supply roll by said peel-off roller providing the desired tension on said band and providing the only means for controlling rotation of said supply roll to restrain the rotation of said supply roll.

2. An unwinding system according to claim 1 wherein said peel-off roller is mounted on said arm at a position spaced from said pivotal axis a distance at least equal to one-half the maximum diameter of said supply roll.

3. An unwinding system according to claim 1 wherein said band comprises a liner carrying at least one elongated body of resilient material and said band guiding means includes a separating roller positioned between said idler roller and said driving means and having an axis located at a position spaced from the axis of said idler roller.

4. An unwinding system according to claim 3, wherein said separating roller is rotated by frictional engagement with said band.

5. An unwinding system according to claim 4 wherein said band of material comprises a liner carrying at least one elongated body of resilient plastic material separated from said band by said separating roller, a driven roller spaced from said separating roller for carrying said elongated body away from said separating roller and driving means for driving said driven roller by rotation of said separating roller.

6. An unwinding system according to claim 3 wherein said axis of said separating roller is coincident with said pivotal axis of said arm.

7. An unwinding system according to claim 1 wherein said band of material comprises a liner carrying at least one elongated body of resilient plastic material.

8. An unwinding system according to claim 1 wherein said peel-off roller has a rough surface for gripping said band of material.

9. An unwinding system according to claim 8 wherein said rough surface of said peel-off roller is knurled.

* * * * *